United States Patent [19]

Webster et al.

[11] 3,999,986

[45] Dec. 28, 1976

[54] METHOD FOR MAKING HIGH DUCTILITY BERYLLIUM BODIES

[75] Inventors: Donald Webster, Saratoga, Calif.; Aldo E. Vidoz, Buenos Aires, Argentina

[73] Assignee: Lockheed Missiles & Space Company, Inc., Sunnyvale, Calif.

[22] Filed: Apr. 8, 1974

[21] Appl. No.: 459,200

[52] U.S. Cl. ..... 75/226; 75/200; 75/150; 148/126

[51] Int. Cl.[2] ..... B22F 3/00; C22F 1/16

[58] Field of Search ..... 148/126; 75/226, 200, 75/150

[56] References Cited

UNITED STATES PATENTS

| | | | |
|---|---|---|---|
| 3,129,497 | 4/1964 | Johnston et al. | 75/150 |
| 3,418,112 | 12/1968 | Zoran | 75/226 |
| 3,724,050 | 4/1973 | Velten et al. | 75/226 |

OTHER PUBLICATIONS

Martin et al., "Powder Metallurgy," vol. No. 7, 1961, pp. 120–138.

*Primary Examiner*—Brooks H. Hunt
*Attorney, Agent, or Firm*—Richard H. Bryer; Billy G. Corber

[57] ABSTRACT

A method for making high ductility beryllium bodies by controlling beryllium oxide particle growth during hot pressing of beryllium powder to a maximum median size of 150 nm. More particularly, particle size is controlled by utilizing starting beryllium powder containing a maximum total concentration of aluminum, silicon and magnesium of 200 ppm and consolidating the powder at a maximum temperature of 1400° F. Ductility is also enhanced by utilizing starting beryllium powder containing a maximum beryllium oxide volume fraction of 1.6 percent and annealing the consolidated powder at temperatures of from 2000° to 2250° F. The anneal can be a separate operation or a continuation of the hot pressing operation.

4 Claims, 7 Drawing Figures

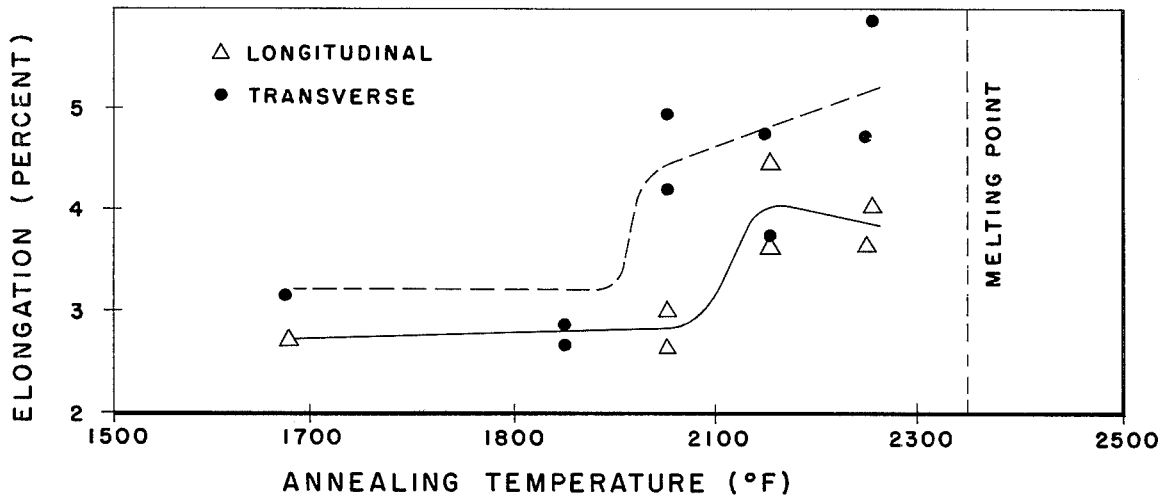
FIG. 6
FIG. 7
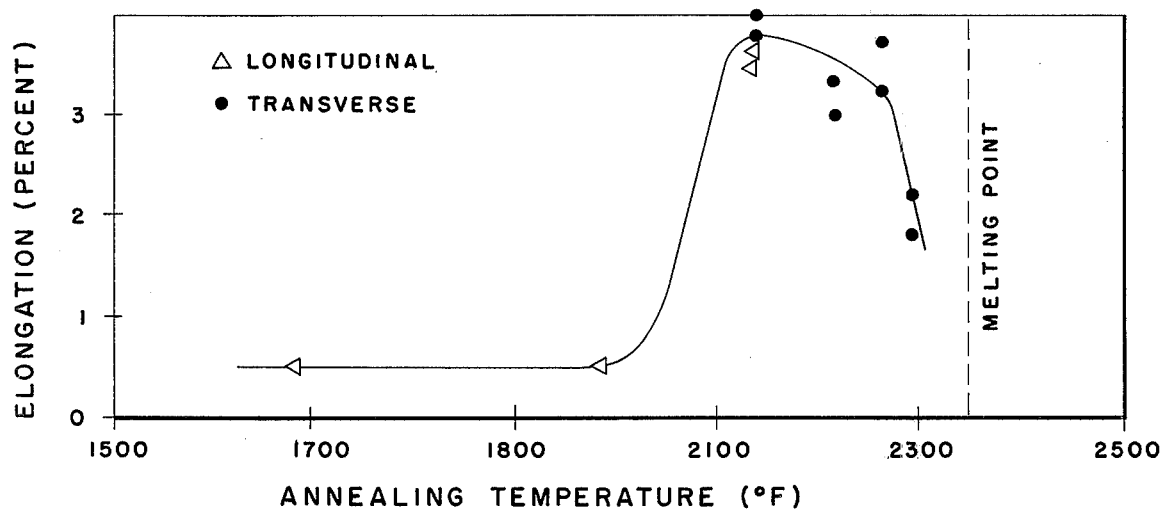

METHOD FOR MAKING HIGH DUCTILITY BERYLLIUM BODIES

BACKGROUND OF THE INVENTION

Advancing technology is constantly demanding strong, stiff and light metals. A metal fulfilling these requirements is beryllium and beryllium alloys which are lighter than aluminum and more rigid than steel. However, beryllium is not widely used because by metallic standards it is brittle. The atomic structure is such that in the polycrystalline form its atoms cannot slip in enough directions to permit the individual metallic grains to deform without cracking. This characteristic of beryllium makes it advantageous properties less attractive since once a small crack is initiated, it can grow easily and cause failure of the entire component. It would be of great benefit to fabricators and designers if beryllium's tendency to failure at a low strain were modified so that uniform strains of 5 – 10% could be applied before failure. This would bring beryllium's strain to fracture into line with that of other high strength engineering materials such as low alloy steels, titanium and aluminum alloys. The brittleness of beryllium at room temperature has been recognized since 1937 (see, W. Kroll, Metals and Alloys, Vol. 8, 1937, p. 349) and between then and the present time, numerous research programs have been undertaken with the object of improving ductility.

These programs have met with little success but results will be briefly described since in some cases they involve tehcniques which are closely related to those described in the instant application.

The relevant techniques in the prior art are purification, grain refinement and heat treatment. In the prior work on purification extremely pure (99.999%) beryllium has been produced by zone refining in an effort to remove dissolved elements that might be embrittling the metal grains. This purification did improve ductility in certain orientations in single crystals but in normal polycrystalline beryllium, ductility was virtually unchanged. In the present invention, high purity is stressed, not because impurities might embrittle the grains as in the prior work, but to avoid the formation of a liquid phase which will coarsen the beryllium oxide particles.

The prior work on grain refinement of beryllium has involved cold working and recrystallization of both castings and hot pressed block and the hot pressing of ultrafine powders. Cold working and recrystallization have the disadvantage of producing a material with a high degree of crystallographic texture and anisotropic mechanical properties. The use of ultrafine powders, while producing a small initial grain size, does so at the expense of an increased oxide content which, as will be subsequently discussed, reduces ductility. In addition, applicants have found that fine grain structures produced by any means will not be stable during hot pressing or high temperature annealing treatments unless the median grain boundary beryllium oxide size is maintained below critical sizes.

The use of heat treatment to improve the room temperature ductility of beryllium has been largely unsuccessful. Some improvement in elevated temperature ductility in relatively impure materials has been achieved by aging at temperatures less than 1450° F to form a ternary compound AlFeBe (see, J. A. Carrabine et al, AIME Met. Society Conferences, Vol. 33. Beryllium Technology, Vol. 1, 1966, p. 239 ). A stress relieving treatment less than 1500° F is normally given to beryllium block to remove residual cold work produced by thermal stresses after pressing. Stress relieving treatments above 1500° F are not normally given to conventional hot pressed beryllium block. It has not previously been recognized by the art that annealing treatments above 2000° F are necessary and desirable in block processed to contain a finer than normal oxide particle size. This effect is a result of the higher recrystallization temperature of block containing fine particles.

SUMMARY OF THE INVENTION

Briefly, in accordance with the invention, there is described a process for making high ductility beryllium and beryllium alloy bodies permitting application of uniform strains of from three percent to eight percent and higher. More particularly, by the process of the invention, enhanced beryllium ductility is realized by limiting beryllium oxide particle growth during hot pressing to a maximum median size of 150 nm by utilizing starting beryllium powder containing a maximum total concentration of significant impurities of aluminum, silicon and magnesium of 200 ppm and consolidating the powder to essentially full density at a maximum temperature in the order of 1400° F.

Ductility is also enhanced by utilizing starting beryllium powder containing a maximum beryllium oxide volume fraction of 1.6 percent to control the number of grain boundary beryllium oxide particles and annealing the consolidated body at temperatures in the order of 2000° F to 2250° F to reduce residual cold work existing in the consolidated body.

BRIEF DESCRIPTION OF THE DRAWING

The invention may be more easily understood from the following description and drawing in which:

FIG. 6, on coordinates of percent longitudinal and transverse elongation and annealing temperature (° F), is a plot showing the effect of temperature on ductility of a hot pressed body; and FIG. 7, on coordinates of percent longitudinal and transverse elongation and annealing temperature (° F), is a plot showing the effect of temperature on ductility of a hot pressed body.

DESCRIPTION OF THE PREFERRED EMBODIMENTS

During the following discussion, reference should be had to Table A for the compositions of the discussed beryllium samples.

TABLE A

MATERIALS USED
Composition (Percent by Weight - remainder BE)

| Alloy | BeO | Al | Mg | Si | Fe | C |
|---|---|---|---|---|---|---|
| RR242 | 2.01 | 0.0035 | 0.0030 | 0.0205 | 0.0650 | 0.0370 |
| RR243 | 1.56 | 0.0016 | 0.0030 | 0.0036 | 0.0550 | 0.0200 |
| BTP5 | 2.64 | 0.0033 | 0.0200 | 0.0150 | 0.0975 | 0.0560 |
| BSP9(W9) | 1.06 | 0.0154 | 0.0042 | 0.0159 | 0.0250 | 0.0520 |
| BSP10 | 0.99 | 0.0265 | 0.0105 | 0.0390 | 0.0915 | 0.1040 |
| W17A | 1.03 | 0.0155 | 0.0045 | 0.0160 | 0.0300 | 0.0350 |
| 1353 | 3.37 | 0.0050 | 0.0080 | 0.0470 | 0.0730 | 0.0640 |
| 1363 | 3.37 | 0.0080 | 0.0050 | 0.0550 | 0.0720 | 0.0670 |
| 1707 | 3.52 | 0.0095 | 0.0175 | 0.0550 | 0.0870 | 0.0450 |
| 1720 | 2.88 | 0.0060 | 0.0020 | 0.0470 | 0.0795 | 0.0380 |
| 1721 | 2.95 | 0.0065 | 0.0020 | 0.0350 | 0.0770 | 0.0420 |
| 8084 | 3.57 | 0.0080 | 0.0020 | 0.0290 | 0.1340 | 0.0850 |
| Ingot | 0.02 | 0.0020 | 0.0050 | 0.0060 | 0.0120 | 0.0220 |
| 9227 | 1.87 | 0.0270 | 0.0445 | 0.0400 | 0.1350 | 0.1000 |
| 9602 | 1.57 | 0.0990 | 0.0290 | 0.0480 | 0.1900 | 0.1000 |
| XN50 | 0.64 | 0.0210 | 0.0035 | 0.0210 | 0.0640 | 0.042 |
| BOP56 | 0.51 | 0.0030 | 0.0030 | 0.0090 | 0.0186 | 0.028 |

Figure 1:
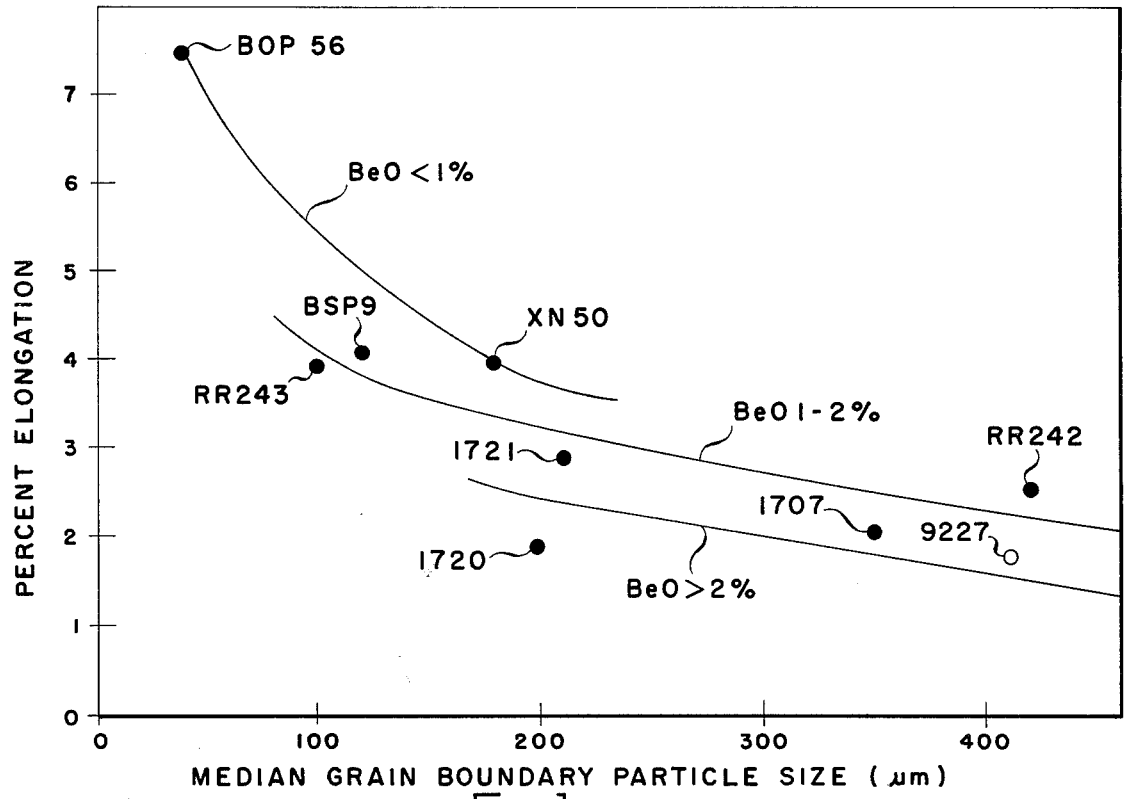
FIG. 1, on coordinates of percent elongation and median grain boundary beryllium oxide particle size (n m), is a plot showing tensile elongation as a function of grain boundary particle size for typical beryllium bodies.

Referring more particularly to FIG. 1, beryllium powder always contains oxide particles resulting from oxidation of the surface of the powder in the atmosphere. The oxide particles remain around the beryllium powder during hot pressing and after pressing are found mainly in the grain boundaries. The oxide particles are brittle and crack easily under an applied load, thereby causing premature failure of the beryllium. A large oxide particle is particularly detrimental since it will cause a larger initial crack than a small particle and produce failure of the beryllium at an earlier stage. Because of this effect, tensile elongation is increased if the median grain boundary beryllium oxide particle size is minimized while other factors are maintained constant as shown in FIG. 1. As therein shown the beryllium oxide particle size is preferably 150 nm or less to realize tensile elongations (the average value of the longitudinal and transverse directions), of three precent and greater. All specimens were heat-treated in accordance with applicants' subsequent teachings to realize maximum elongations.

Applicants have determined the mechanism of growth of the oxide particles and, as a result, are able to define techniques which will limit oxide particle growth and enable beryllium bodies with higher ductility to be produced. Since beryllium alloys inherently contain beryllium oxide, all beryllium bodies, both beryllium and beryllium alloys, will realize the benefit of applicants' invention. This mechanism requires a grain boundary phase which is liquid at the pressing temperature. Because the melting point of beryllium, 2340° F, is well above the pressing temperature, liquid phases are only produced in impure materials. Significant impurities causing low melting phases to ocurr are aluminum, silicon and magnesium.

Figure 2:
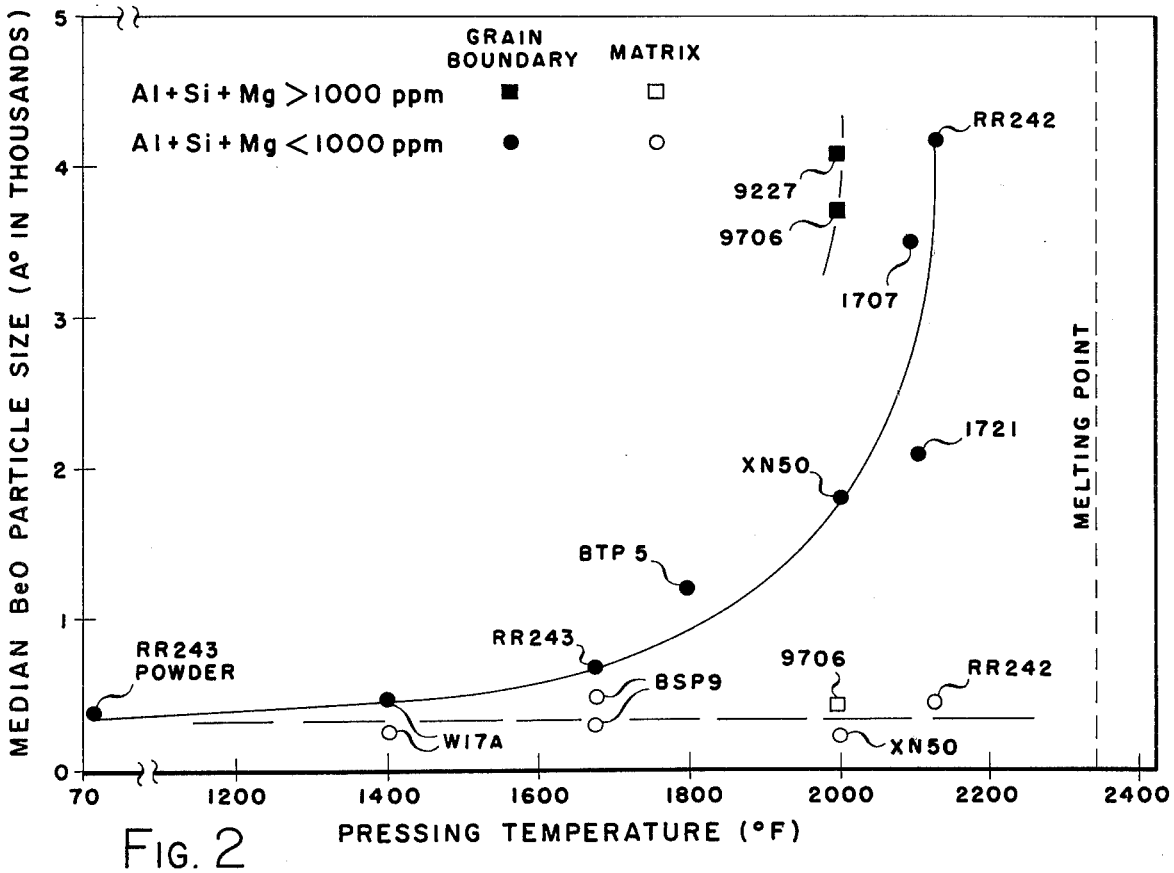
FIG. 2, on coordinates of median beryllium oxide particle size (A) and pressing temperature (° F), is a plot showing the effect of pressing temperature on matrix and grain boundary oxide particle size for typical beryllium bodies.

As shown in FIG. 2, the matrix beryllium oxide particle size is essentially independent of pressing temperature whereas grain boundary oxide particles show significant increase in size for increasing pressing temperatures. Hence, for purposes of the invention, the effect of matrix oxide particles on ductility can be ignored. FIG. 2 also shows the gross impurity level effect on oxide size which is set forth more particularly in FIG. 3.

Figure 3:
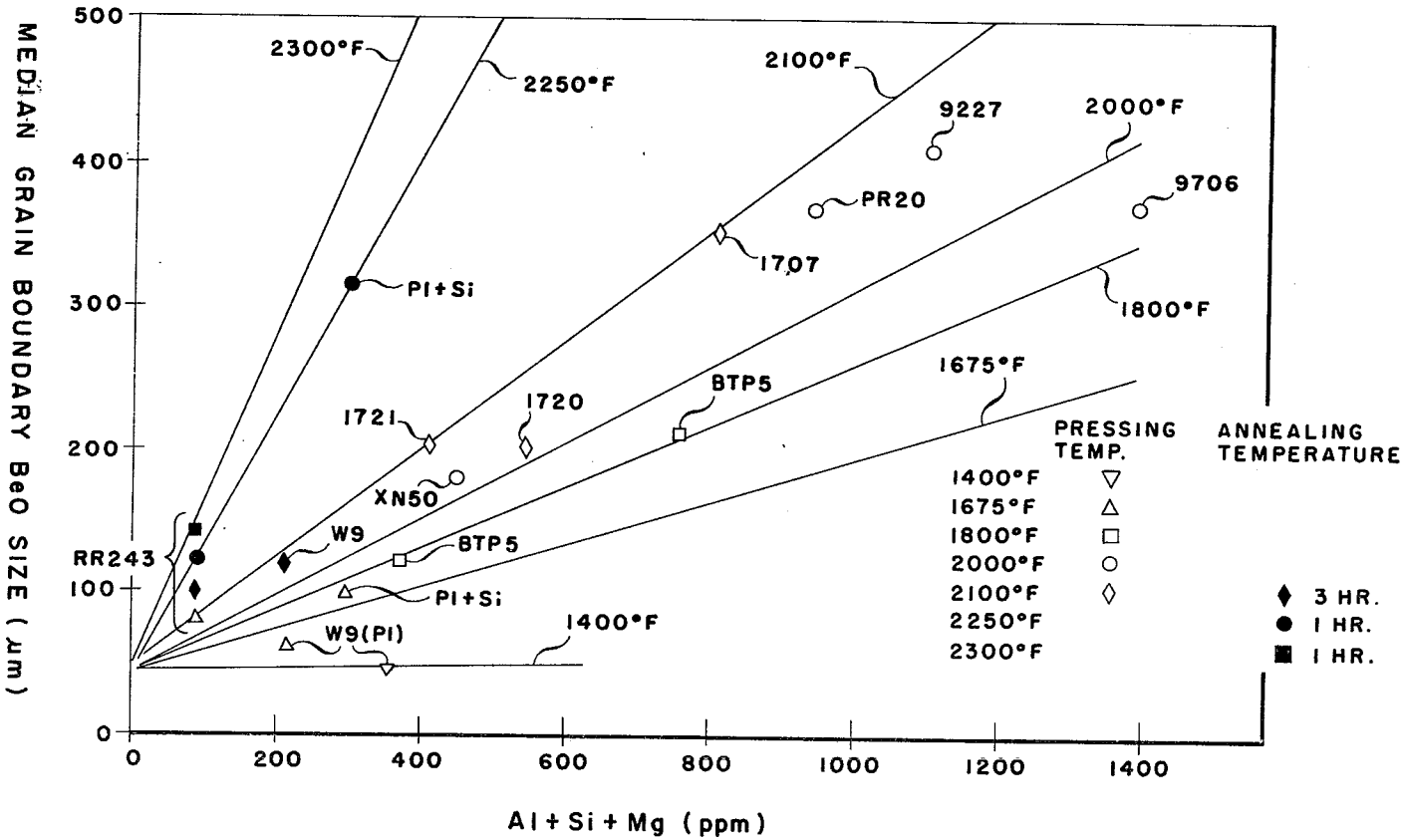
FIG. 3, on coordinates of median grain boundary beryllium oxide size (n m) and significant impurity concentration (p p m), is a plot showing the effect of impurity concentration on oxide size at various pressing and annealing temperatures for various beryllium bodies.
Figure 5:
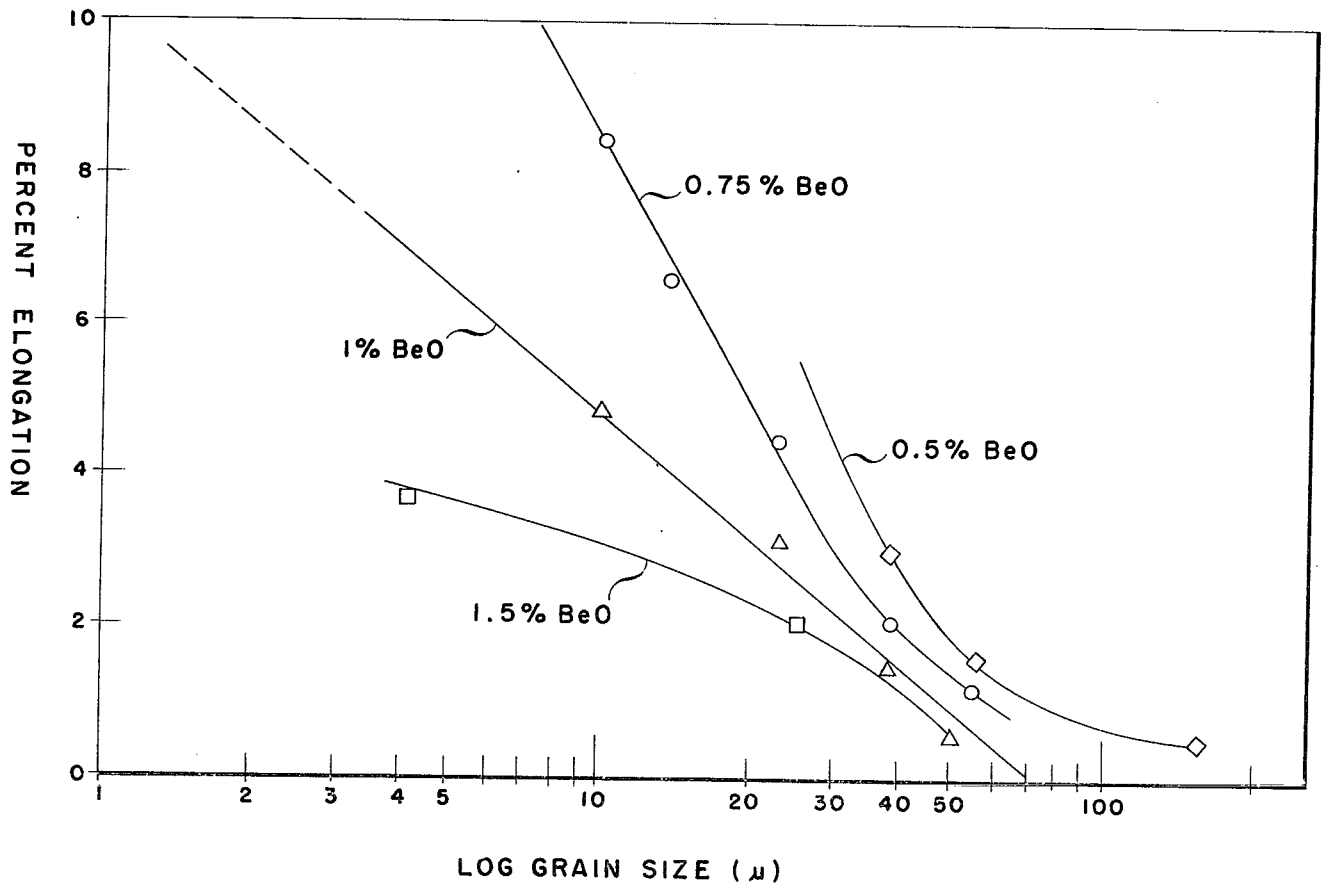
FIG. 5, on coordinates of percent elongation and log grain size (n), is a semilog plot showing enhancement in three dimensional ductility in hot pressed beryllium block with decreasing grain size.

FIG. 3 shows that as the temperature of pressing and annealing is increased, the impurity level has increasing significance on oxide size. Since, impurity concentration and temperature are interdependent, it is possible, within limits, to realize a maximum oxide size of 150 nm by decreasing temperature as concentration increases and vice versa. As will be subsequently discussed in conjunction with FIGS. 5 and 6, a maximum useful temperature is in the order of 2250° F. Accordingly, from FIG. 3, a maximum practical impurity concentration is in the order of 200 ppm for this temperature. As will be subsequently discussed in conjunction with FIGS. 6 and 7, a temperature in the order of 2250° F is the maximum tolerable temperature and lowering the impurity level below 200 ppm will not permit increased temperatures.

It has been determined that while the maximum temperature should be in the order of 2250° F, consolidation of the beryllium powder to full density should occur under temperatures preferably not exceeding about 1400° F. This temperature minimizes the effect of a liquid phase and thereby maintains a median oxide particle size in the hot pressed body not exceeding 150 nm. At this temperature, the effect of the liquid phase and its associated particle growth is localized. After achieving full density at approximately 1400° F, heating may be continued up to the maximum temperature of about 2250° F; such additional heating constituting the annealing portion of the instant invention. Alternatively, when desired, the densified body may be cooled to room temperature and then annealed at temperatures in excess of 1400° F up to the maximum temperature of about 2250° F, as described in conjunction with FIGS. 5 and 6.

The achievement of full density at temperatures not exceeding about 1400° F is achievable by hot isostatic pressing which uses pressures in the order of 15 ksi. Use of conventional hot pressing techniques at pressures of approximately 1 ksi would necessitate stepwise loading sequences where pressure is applied at a constant temperature less than the maximum pressing temperature until the maximum density achievable at that temperature is reached. Several steps of this kind at increasing temperatures below the maximum pressing temperature are required.

The use of a low pressing temperature coupled with a higher annealing temperature has been determined to be consistent with the teachings of the invention since it has been determined that oxide growth after the attainment of full density is less than where liquid movement is unrestricted and oxide agglomeration accordingly more widespread.

Figure 4:
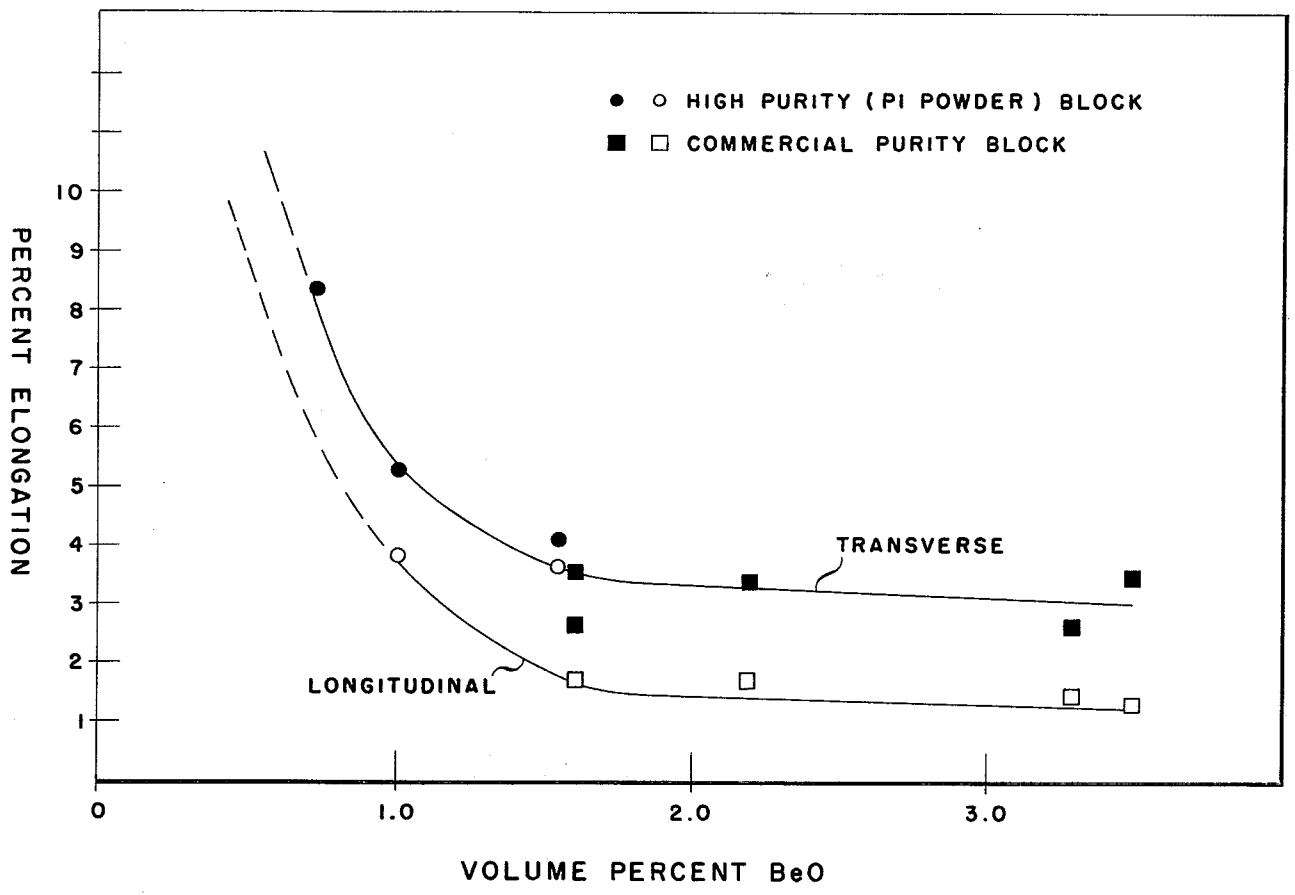
FIG. 4, on coordinates of percent elongation and volume percent beryllium oxide, is a plot showing transverse and longitudinal elongation as function of beryllium oxide volume percent for a typical beryllium body.

As shown in FIG. 4, utilizing alloy RR243, ductilities of three percent and higher are realized if the beryllium oxide content of the starting powder is limited to a maximum volume fraction of about 1.6 percent and preferably one percent. Micrographs of room temperature fractures indicate that a low beryllium oxide content increases ductility by reducing the number of grain boundary oxide clusters that initiate failure. The manufacturing techniques for reducing the amount of beryllium oxide, such as removal of fines less than 5 to 10 nm, are well known. If this reduction in oxide content is not accompanied by an increase in oxide efficiency due to a reduction in oxide particle size to a maximum of about 150 nm, however, an increased grain size will result. For example, in the article by B. B. Lumpany et al, Conference International sur la Metallurgie du Beryllium, Grenoble, May 17–20, 1965, 565–577, Presses Universitaires alloys with 1 to 2.5 percent beryllium oxide produced grain sizes in the range of 22 to 37 um whereas with a refined oxide particle size of 100 um in accordance with the invention, applicants have produced stable grain sizes less than 4 um for 1.5 percent oxide and 10 nm for 1 percent oxide.

It is widely accepted that a reduction in grain size increases tensile elongation of beryllium if other factors are maintained constant. However, in normal practice the degree of grain refinement possible is limited by grain growth and/or recrystallization during pressing or annealing. Grain growth and recrystallization are controlled by the beryllium oxide particles formed on the surface of each beryllium powder particle. Applicants have determined that the efficiency of these particles in this respect is inversely proportional to their size if the volume fraction is maintained constant. Because of this, materials processed according to applicant's procedure for producing a fine oxide size can stabilize a finer grain size or require less oxide to stabilize a given grain size than a conventional oxide dispersion. While a initial fine grain size should be utilized, this is readily achieved in practice simply by selection of fine starting powder. The beneficial effect of grain refinement on three dimensional ductility in hot pressed beryllium block is seen from FIG. 5 to be related to the amount of beryllium oxide that is required to attain the grain size. As shown, if over about 1.6 percent oxide is used, the embrittling effect of the oxide negates the beneficial effect on grain refinement. Based on the preceeding and striking a balance between grain size and oxide volume fraction, the starting beryllium particle size should preferably be between −200 mesh and −400 mesh.

During the manufacture of starting beryllium powder from ingot blocks, a high degree of cold work is left in the powder particles. A residual portion is found to exist in hot pressed beryllium bodies, for example such bodies conventionally formed by hot isostatic pressing where temperatures are typically less than 1800° F. This is revealed microstructurally by the presence of subgrains, and/or a high dislocation density, and by hardness and yield strength measurements. Applicants have discovered that beryllium ductility is further increased if the dislocation density is lowered by annealing the hot pressed body. FIG. 6 shows that, for a typical BSP 9 alloy, an annealing temperature of at least 2000° F is required to noticeably increase ductility. FIG. 7 shows that, for a typical RR 243 alloy, the maximum annealing temperature is about 2250° F above which a significant decrease in ductility commences.

The upper limited of about 2250° F for the annealing temperature is set by several factors: (i) the onset of grain growth in the beryllium, (ii) void growth due to trapped gases, and (iii) beryllium oxide particle size growth. It has been determined that a median oxide particle size no greater than about 150 um is realized at an impurity concentration level of about 200 ppm if the annealing temperature does not exceed about 2100° F. As the impurity level is lowered, the annealing temperature can be increased up to about 2250° F without increasing particle size above 150 nm. Above 2250° F, however, decreasing impurity level will not obviate a significant lowering in ductility due to the onset of grain growth and void growth due to trapped gases. Regarding void growth, during the manufacture of beryllium block by hot isostatic pressing it is inevitable that some absorbed gases are trapped within the block. These gases are present after pressing as very small voids uniformly distributed throughout the body. In this form, their effect on ductility is minimal. However, annealing above about 2250° F causes the voids to grow to such an extent that ductility is impaired.

The maximum annealing temperature may also be limited to less than 2250° F in cases where deliberate impurity additions are made to the beryllium powder. For example, silicon is on occasion added in the form of trichlorosilane as a sintering aid and becomes concentrated at the grain boundaries. Silicon in this form has been found to be two to three times as detrimental as silicon uniformly dispersed throughout the beryllium oxide particle agglomeration. Depending on the trichlorosilane concentration, it may not be possible to anneal at applicants' minimum temperature of about 2000° F without offsetting the otherwise beneficial effect of the anneal on ductility.

Typically, maximum ductility is attained for anneals of one to five hours duration. However, in view of the vast number of beryllium alloys susceptible of being processed by the instant invention, the specific temperature - time relationship for a given alloy is readily ascertainable in accordance with the preceeding teachings.

What is claimed is:

1. A method of enhancing beryllium ductility by limiting beryllium oxide particle growth during hot pressing of beryllium powder to a maximum median size of 150 nm, said method comprising the steps of utilizing starting beryllium powder containing a maximum total concentration of aluminum, silicon and magnesium of 200 ppm, consolidating said starting powder at a maximum temperature of 1400° F to essentially full density, and annealing said body at temperatures from about 2000° to 2250° F.

2. A method in accordance with claim 1 wherein a number of grain boundary beryllium oxide particles is controlled during hot pressing by utilizing starting beryllium powder containing a maximum beryllium oxide volume fraction of 1.6 percent.

3. A method in accordance with claim 2 wherein the maximum beryllium oxide volume fraction is one percent.

4. A method in accordance with claim 1 wherein said temperatures are from about 2000° to 2100° F.

* * * * *